US006111549A

United States Patent [19]

Feller

[11] Patent Number: 6,111,549

[45] Date of Patent: Aug. 29, 2000

[54] FLEXIBLE CIRCUIT ANTENNA AND METHOD OF MANUFACTURE THEREOF

[75] Inventor: Walter J. Feller, Scottsdale, Ariz.

[73] Assignee: Satloc, Inc., Scottsdale, Ariz.

[21] Appl. No.: 08/866,323

[22] Filed: Jun. 18, 1997

Related U.S. Application Data

[60] Provisional application No. 60/042,475, Mar. 27, 1997.

[51] Int. Cl.[7] ..... H01Q 9/28

[52] U.S. Cl. ..... 343/795; 343/797; 343/700 MS

[58] Field of Search ..... 343/795, 797, 343/95, 830

[56] References Cited

U.S. PATENT DOCUMENTS

| | | | |
|---|---|---|---|
| 3,596,228 | 7/1971 | Reed, Jr. et al. | 339/59 |
| 3,815,272 | 6/1974 | Marleau | 43/12 |
| 3,987,456 | 10/1976 | Gelin | 343/830 |
| 4,529,990 | 7/1985 | Brunner | 343/779 |
| 4,689,556 | 8/1987 | Cedrone | 324/158 P |
| 4,694,264 | 9/1987 | Owens et al. | 333/34 |
| 4,710,775 | 12/1987 | Coe | 343/727 |
| 4,714,435 | 12/1987 | Stipanuk et al. | 439/496 |
| 4,864,320 | 9/1989 | Munson et al. | 343/833 |
| 4,916,577 | 4/1990 | Dawkins | 343/850 |
| 5,155,493 | 10/1992 | Thursby et al. | 343/700 MS |
| 5,165,109 | 11/1992 | Han et al. | 343/700 MS |
| 5,173,715 | 12/1992 | Rodal et al. | 343/795 |
| 5,191,351 | 3/1993 | Hofer et al. | 343/895 |
| 5,239,669 | 8/1993 | Mason et al. | 455/12.1 |
| 5,444,453 | 8/1995 | Lalezari | 343/700 MS |
| 5,521,610 | 5/1996 | Rodal | 343/797 |
| 5,523,761 | 6/1996 | Gildea | 342/357 |
| 5,568,162 | 10/1996 | Samsel et al. | 343/842 |
| 5,589,835 | 12/1996 | Gildea et al. | 342/357 |
| 5,600,670 | 2/1997 | Turney | 375/208 |
| 5,604,506 | 2/1997 | Rodal | 343/791 |
| 5,610,522 | 3/1997 | Locatelli et al. | 324/319 |
| 5,706,015 | 1/1998 | Chen et al. | 343/700 MS |
| 5,864,318 | 1/1999 | Cosenza et al. | 343/700 MS |

*Primary Examiner*—Don Wong
*Assistant Examiner*—Hoang Nguyen
*Attorney, Agent, or Firm*—Cantor Colburn LLP

[57] ABSTRACT

An antenna and method of manufacturing thereof. The antenna includes an integral antenna element, support and base, all manufactured from a flexible circuit material. A stiffener material is added to the flexible circuit material where needed to provide rigidity. When the antenna is mounted in an antenna system, foam is injected around the antenna to enhance stability. The antenna is made from flexible circuit material using printed circuit board manufacturing techniques and thus manufacturing can be highly automated with excellent repeatability.

13 Claims, 8 Drawing Sheets

FLEXIBLE CIRCUIT ANTENNA AND METHOD OF MANUFACTURE THEREOF

CROSS REFERENCE TO RELATED APPLICATIONS

This application claims the benefit of U.S. Provisional Patent Application Ser. No. 60/042,475 filed Mar. 27, 1997.

BACKGROUND OF THE INVENTION

1. Field of the Invention

The invention relates in general to antennas and in particular to an antenna having an integral ground plane, support and antenna element all made from a flexible circuit material.

2. Prior Art

Antennas for global positioning systems (GPS) are known in the art and an exemplary conventional GPS antenna system is shown generally at 1 in FIG. 1. The conventional antenna system includes an antenna element 2 mounted to a center support 4 which is mounted to a metal base 6. A dome 8 and bottom housing 9 enclose these components. The antenna element 2 is made from a flexible circuit and the ends of the antenna element 2 are attached to perimeter points of the base 6. A disadvantage of the conventional antenna system is that it requires extensive assembly during manufacturing. The antenna element 2 must be connected to the support 4 and the support 4 must be connected to the base 6. In addition, the ends of the antenna element 2 are attached to the base 6. Another disadvantage is that the tolerance and repeatability in manufacturing is limited thereby introducing variations from one antenna system to the next. Attaching the ends of the antenna element 2 to the base 6 creates limitations on the gain patterns available and the bandwidths obtainable.

SUMMARY OF THE INVENTION

The above-discussed and other drawbacks and deficiencies of the prior art are overcome or alleviated by the flexible circuit antenna of the present invention. The present invention is an antenna having an integral antenna element, support and base, all manufactured from a flexible circuit material. Support material is added to the flexible circuit material where needed to provide rigidity. When the antenna is mounted in an antenna system, foam is injected around the antenna to enhance stability. The basic antenna, without support materials or adhesives, is made from flexible circuit material and thus manufacturing can be highly automated with excellent repeatability. The addition of foam around the flexible circuit antenna provides structural support and maintains the desired antenna shape.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
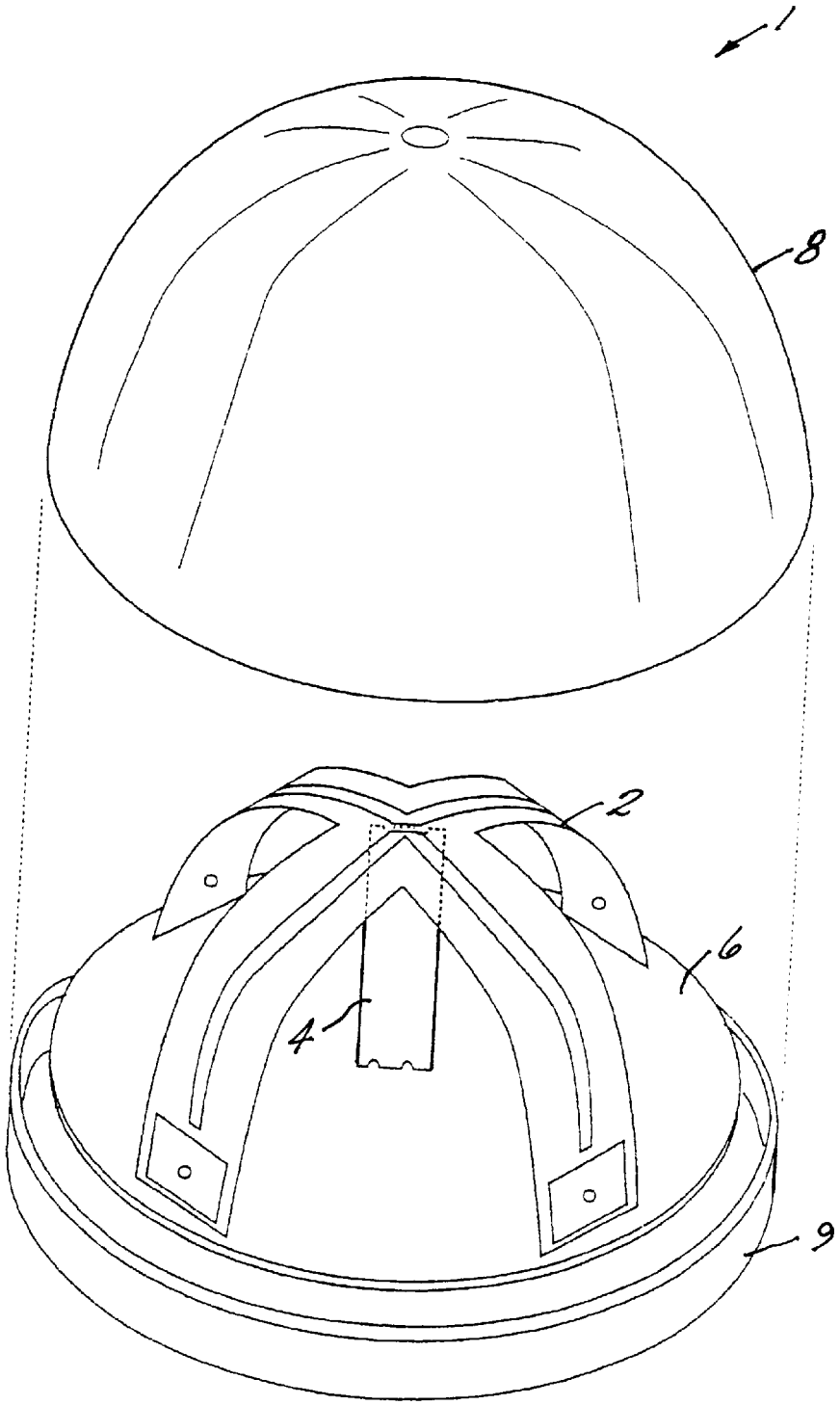
FIG. 1 (PRIOR ART)
FIG. 1 a perspective view of a conventional GPS antenna.
Figure 2:
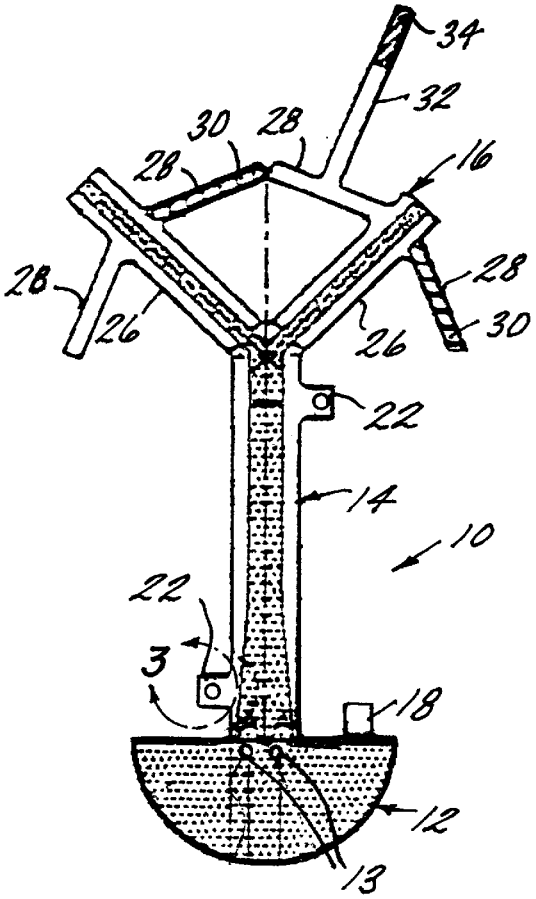
FIG. 2 is a front view of a first half of an antenna in accordance with the present invention.

FIG. 2 is a front view of a first half of an antenna in accordance with the present invention, shown generally at 10. The first antenna half 10 is made up of a ground plane 12, a support 14 and an antenna element 16. The ground plane 12 is a semi-circular region which will be folded to be substantially perpendicular to support 14 when the antenna is placed in its assembled state (shown in FIG. 10). A pressure sensitive adhesive, covered by a release sheet, is formed on one surface of the ground plane 12. When the antenna is mounted in an antenna system, the release sheet is peeled away and the antenna is mounted to a portion of the antenna system. The layers of the ground plane 12 are described in detail below with reference to FIG. 8. It is understood that other geometries for the ground plane may be used and the invention is not limited to semi-circular. A tab 18 extends away from the ground plane 12. Tab 18 has an exposed copper surface that contacts an exposed copper region 20' on the second ground plane 12' shown in FIG. 6. Tabs 18, 18' and the exposed copper regions 20, 20' place the ground planes 12, 12' in electrical contact to provide a uniform potential on the ground plane. Holes 13 are formed in the ground plane 12 proximate to the junction between the support 14 and the ground plane 12. Holes 13 can receive pins on a connector in embodiments where a low noise amplifier (LNA) printed circuit board is not used (shown in FIG. 15).

Figure 3:
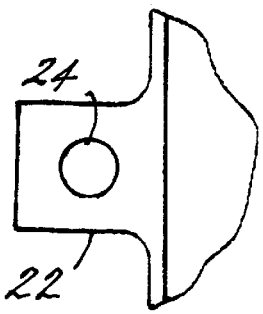
FIG. 3 is an enlarged view of a portion of FIG. 2.

Support 14 is integral with the ground plane 12 and is also made from a flexible circuit material. As will be described in detail below with reference to FIG. 7, a stiffener is applied to support 14 prior to assembling the first antenna half 10 and the second antenna half 10'. The support 14 has two extensions 22 which have an opening 24 therein as shown in FIG. 3. Second antenna half 10' has similar extensions 22'. The extensions 22 and 22' facilitate aligning the two antenna halves 10 and 10' and allow the antenna halves 10 and 10' to be mechanically connected via a fastener passing through openings 24 and 24'.

Antenna element 16 includes two arms 26 that extend away from support 14. In the exemplary embodiment shown in FIG. 2, the arms 26 extend from the support at an angle of 45 degrees. It is understood that other angles may used.

The layers making up arms 26 are described below with reference to FIG. 9. Extending away from each arm 26 are a pair of arm extensions 28. In the exemplary embodiment shown in FIG. 2, the arm extensions 28 extend from the arms 26 at an angle of 112.5 degrees. It is understood that other angles may used. One of the arm extensions extending off each of the arms 26 has a surface coated with a pressure sensitive adhesive 30. When the two antenna halves 10 and 10' are assembled as shown in FIG. 10, pairs of adjacent arm extensions 28 are coupled through adhesive 30. An arm support 32 extends substantially perpendicular to one of the arm extensions 28. The arm support 32 includes a pressure sensitive adhesive 34 on a surface thereof. When the antenna is placed in the assembled state as shown in FIG. 10, the adhesive 34 connects the arm support 32 to the main support 14.

Figure 4:
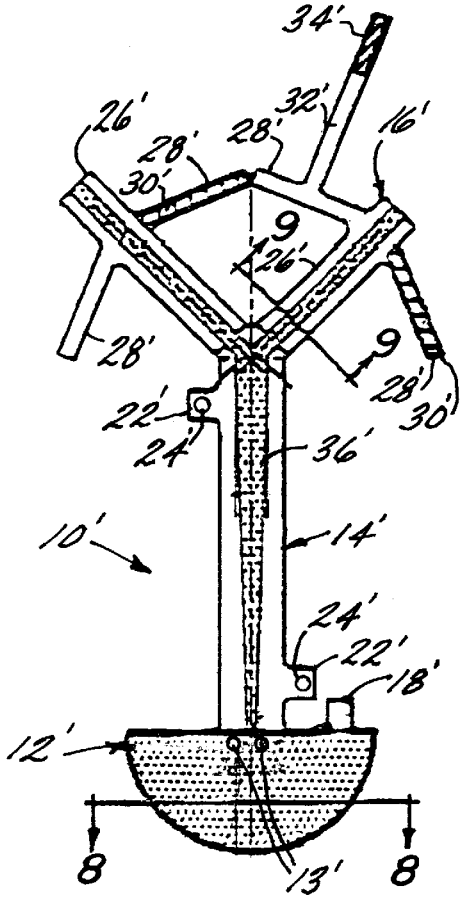
FIG. 4 is a front view of a second half of the antenna in accordance with the present invention.

FIG. 4 is a front view of the second antenna half 10'. Second antenna half 10' is similar to first antenna half 10 and similar references numerals are used in FIG. 4, with the addition of a prime. An important aspect of the invention is shown in FIG. 4. The support 14 includes a tapered copper region 36' that provides the feed network and matching network. The tapered strip of copper 36' is coupled to an unbalanced 50 Ohm coaxial feed and converts it into a balanced mode, with an impedance of roughly 35 Ohms, for matching to the arms 26.

Figure 5:
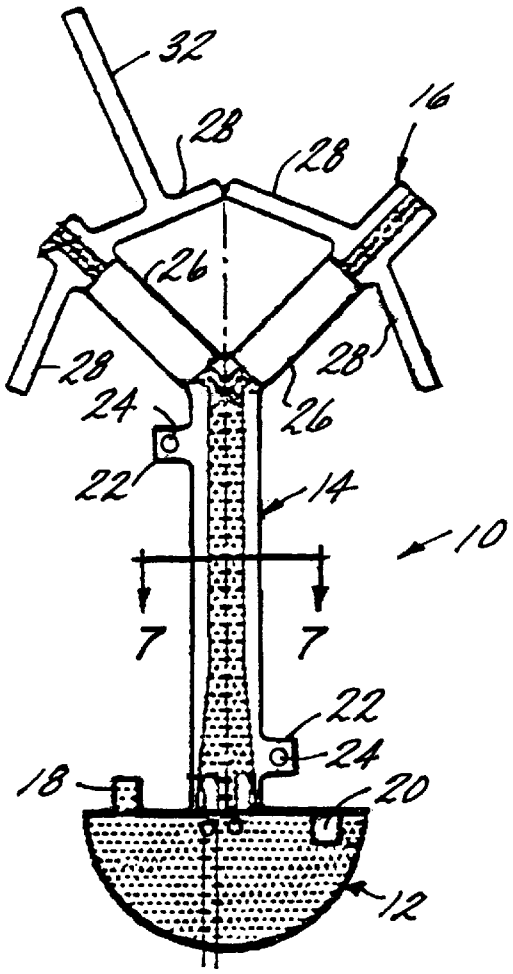
FIG. 5 is a rear view of the first half of the antenna.
Figure 6:
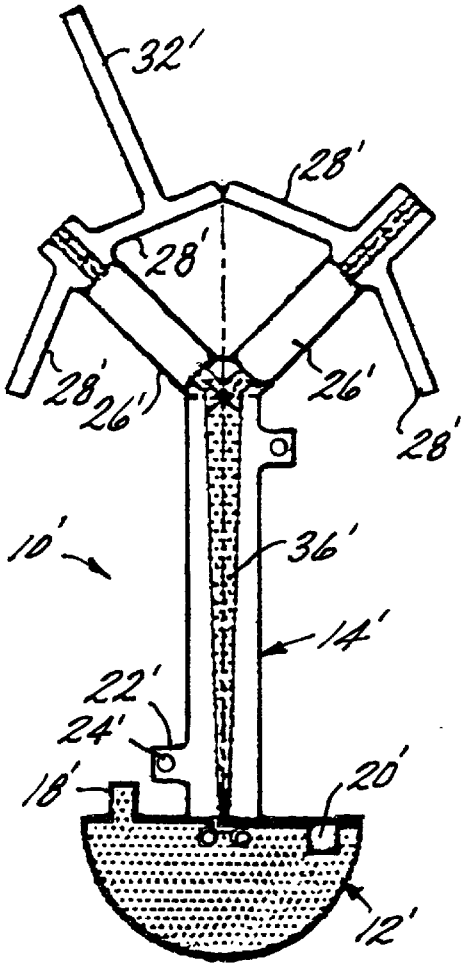
FIG. 6 is a rear view of the second half of the antenna.

FIG. 5 is a rear view of the first antenna half 10. As shown in FIG. 5, the ground plane 12 includes an exposed copper region 20 that contacts tab 18' on the ground plane 12' on the second antenna half 10'. FIG. 6 similarly shows the exposed copper region 20' on the ground plane 12' that contacts tab 18 on the first ground plane 12.

Figure 7:
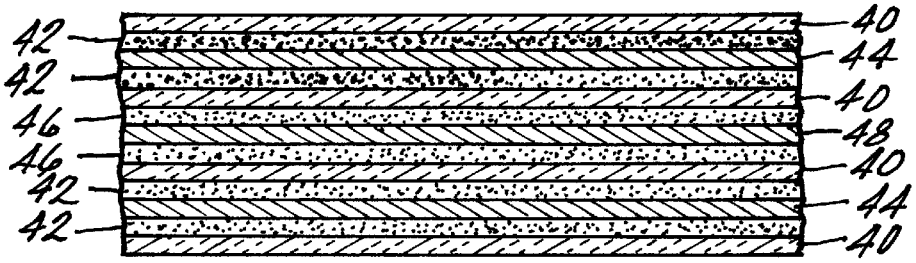
FIG. 7 is a cross-sectional view taken along line 7—7 of FIG. 5.

FIG. 7 is a cross-sectional view of the assembled first and second antenna halves 10, 10' taken along line 7—7 of FIG. 5. Layer 40 is an insulative material (e.g. Kapton) which is joined, through an adhesive layer 42, to a conductor layer 44 (e.g. copper). Another adhesive layer 42 and insulative layer 40 encase the conductor layer 44. This first encased conductor layer corresponds to the first antenna half. A similarly encased conductor layer is formed opposite the first conductor layer and corresponds to the second antenna half. Between the first and second antenna halves is a stiffener 48 that is connected to the first and second antenna halves through an adhesive 46 (e.g. thermoset acrylic adhesive). The stiffener 48 provides rigidity to the support 14.

Figure 8:
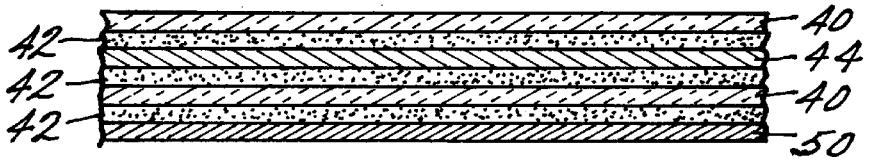
FIG. 8 is a cross-sectional view taken along line 8—8 of FIG. 4.

FIG. 8 is a cross-sectional view of the ground plane 12. It is understood that ground plane 12' is similarly constructed. The ground plane 12 is similar to the support 14 in that it includes a conductor layer 44 encased in insulative layers 40 through adhesive layers 42. The ground plane 12 also includes an additional adhesive layer 42 and a release sheet 50. When the antenna is placed in its assembled state as shown in FIG. 10, the release sheet 50 is removed from the ground planes 12 and 12' and the ground plane is attached to a portion of the antenna system.

Figure 9:
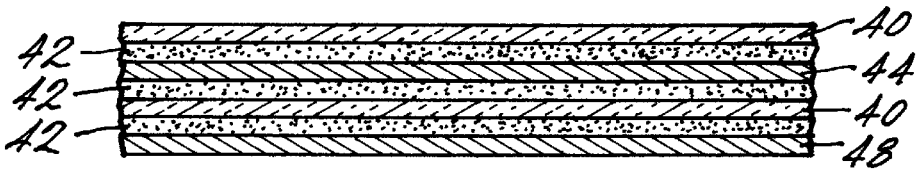
FIG. 9 is a cross-sectional view taken along line 9—9 of FIG. 4.
Figure 10:
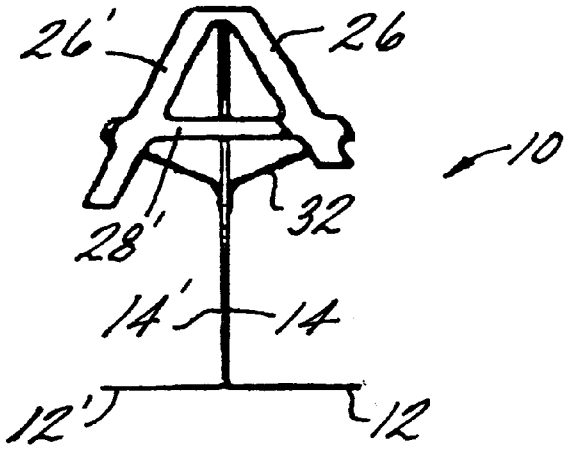
FIG. 10 is a side view of the antenna in an assembled state.

FIG. 9 is a cross-sectional view of one of the arms 26 shown in FIG. 4. The arm 26 includes an encased conductor layer 44 positioned between adhesive layers 42 and insulative layers 40. In addition, another adhesive layer 42 and a stiffener 48 is applied to one surface of the arm 26. This provides structural integrity to the arm 26 and facilitates placing the arm is its assembled state shown in FIG. 10. By placing the stiffener along the support 14 and portions of the arms 26, the antenna easily assumes its assembled state. The flexible circuit material bends where the stiffener is not applied to enable folding of the antenna.

The method of manufacturing the antenna system of the present invention will now be described. The first and second antenna halves 10 and 10' are manufactured using conventional flexible circuit manufacturing techniques. As described above, the ability to manufacture the antenna using printed circuit board processes provides a reduced cost and high repeatability. Stiffener 50 is applied to arms 26 on both antenna halves 10, 10' and adhesive (e.g. thermoset acrylic adhesive) is applied to the supports 14, 14'. Stiffener 48 is applied to one of the supports (e.g. 14) and the two antenna halves 10, 10' are assembled. As described above, extensions 22 and 22' facilitate aligning the antenna halves and provide for mechanical fastening of the antenna halves 10 and 10'.

Once the two antenna halves 10, 10' are joined, the antenna is folded into its assembled state as shown in FIG. 10. The arms 26 are bent towards the support 14. Adjacent arm extensions 28 are connected to each other through adhesive 30. The arm supports 32 and 32' are folded towards the main support 14 and are connected to the main support 14 through adhesive 34. The ground planes 12 and 12' are folded towards the main support 14 so that tabs 18 and 18' contact exposed copper areas 20' and 20, respectively.

Figure 11:
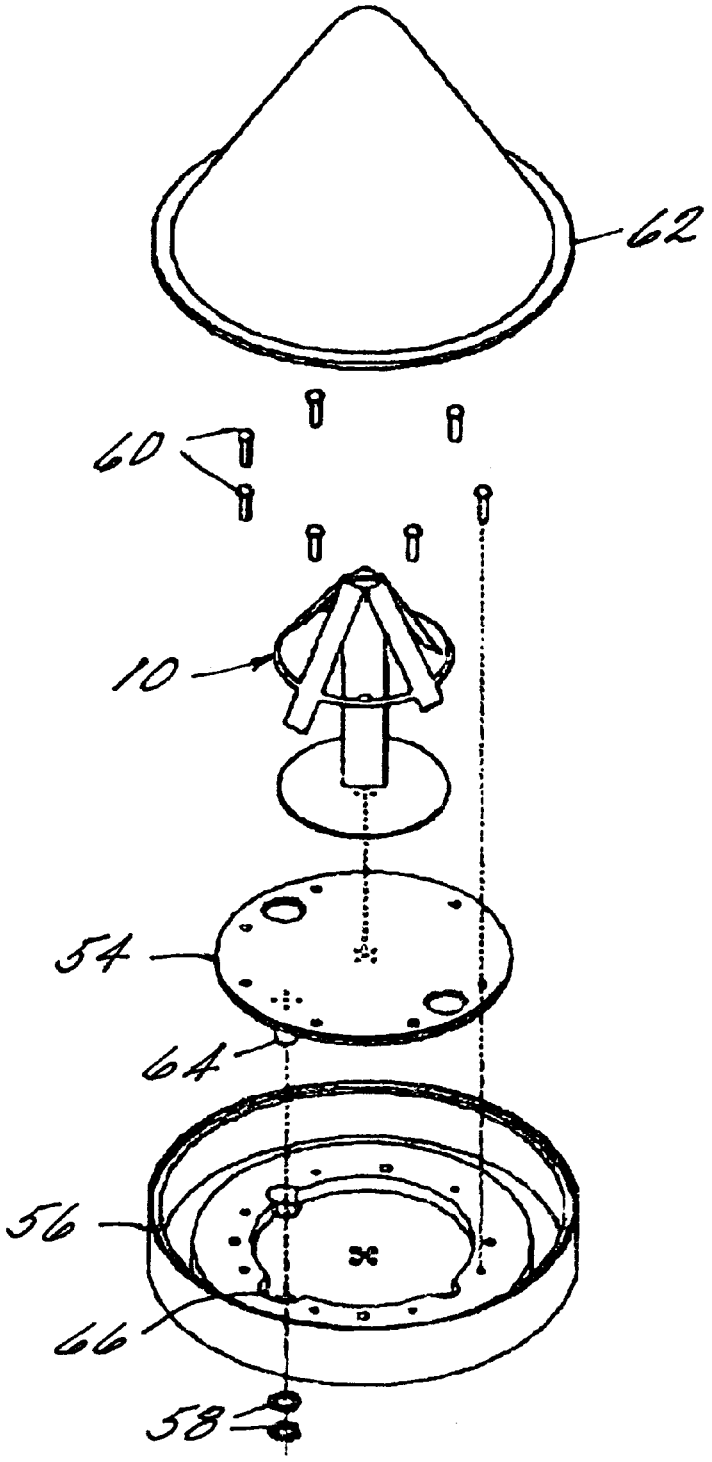
FIG. 11 is an exploded perspective view of an antenna system including the antenna of the present invention.
Figure 13:
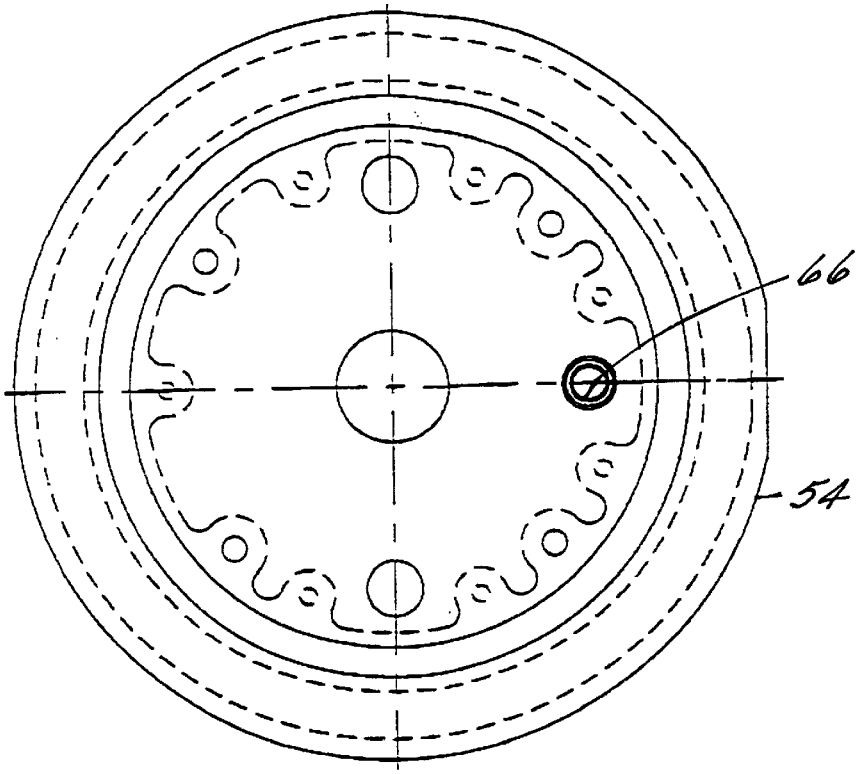
FIG. 13 is a bottom view of the baseplate of the antenna system.
Figure 14:
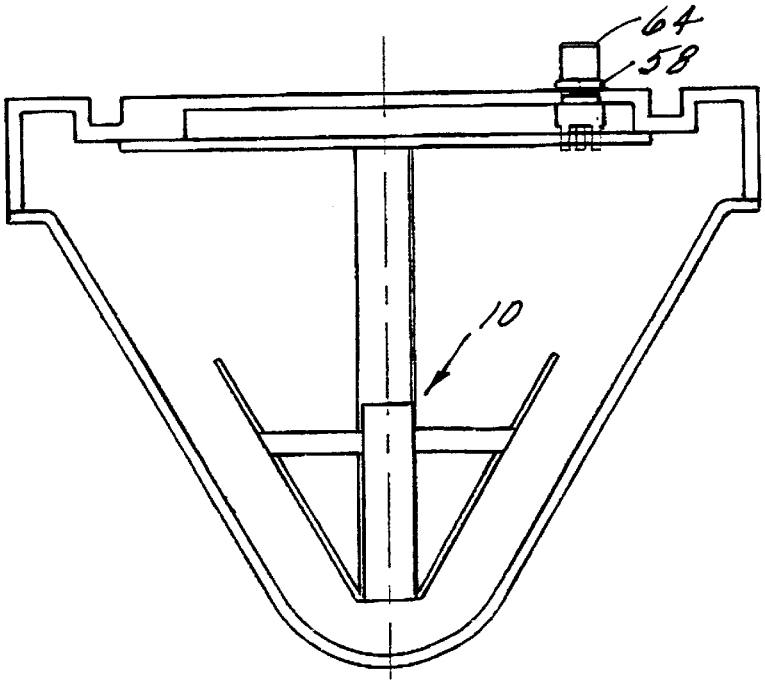
FIG. 14 is a cross-sectional view of the antenna system.

The antenna 10 is then placed in an antenna system as shown in the exploded view of FIG. 11. The antenna 10 is first mounted to a low noise amplifier (LNA) printed circuit board (PCB) 54 by removing release sheets 50 that cover the adhesive on each ground plane 12. The LNA PCB 54 is then placed in a baseplate 56. Fasteners 60 secure the periphery of the LNA PCB 54 to the baseplate 56. A connector (e.g. female coaxial connecter) 64 extends through a hole 66 in the baseplate 56 and is secured to the baseplate through hardware 58 (washers, nuts, etc.). An RF transparent cap 62 is then mounted to the baseplate 56. The cap 62 and baseplate 56 protect the antenna 10 from environmental conditions. FIG. 13 is a bottom view of the baseplate 54 and FIG. 14 is a cross-sectional view of the antenna 10 mounted in the antenna system.

Figure 12:
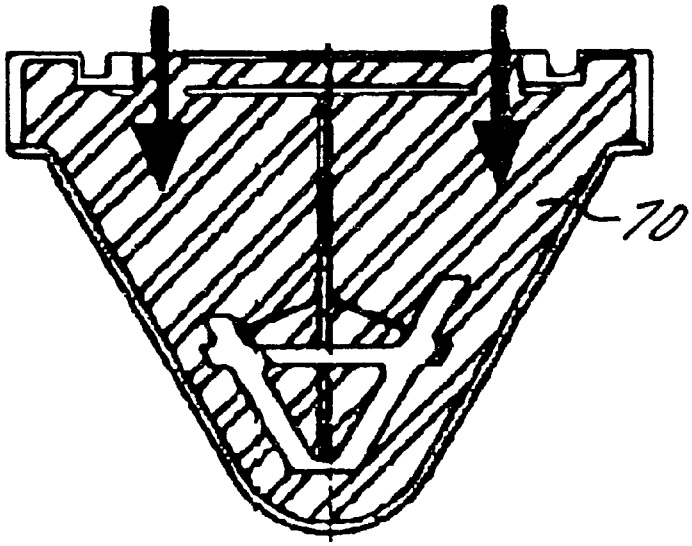
FIG. 12 is a cross-sectional view of the antenna system of the present invention.
Figure 15:
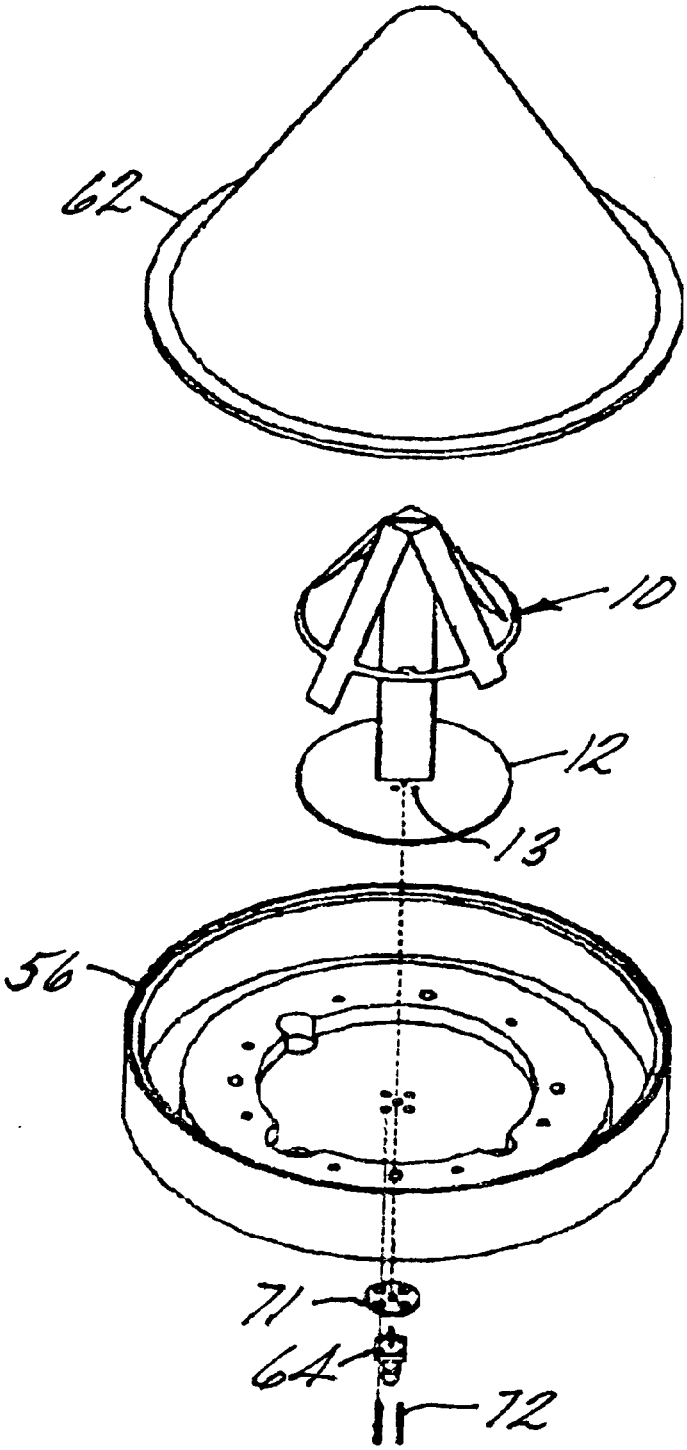
FIG. 15 is an exploded perspective view of an alternative antenna system including the antenna of the present invention.

In accordance with an important aspect of the invention, the antenna is then foamed in place by injecting an RF transparent foam 70 (e.g. a low-loss, low density rigid foam) into the antenna system as shown by the arrows in FIG. 12. The foam provides structural support for the antenna 10 and allows the antenna to be manufactured entirely from flexible circuit material. The foam 70 provides the antenna system with a durability similar to metal antennas without the expense and low repeatability of manufacturing all metal antennas. FIG. 15 is an exploded view of an antenna system in which the LNA PCB has been eliminated. As shown in FIG. 15, the antenna is attached directly to the baseplate 56 through the adhesive 50 on the surface of the ground plane of the antenna. A support plate 71 is aligned with the holes 13 formed in the antenna ground plane 12 and pins from a connector (e.g. female coaxial) make electrical contact with the antenna 10. Fasteners 72 hold the connector 64 to the baseplate. The antenna 10 is foamed in place as shown in FIG. 12.

The assembled antenna may be used with a wide bandwidth due to the width of the arms 26 and the wideband matching network/ balanced to unbalanced (balun) converter provided by tapered copper region 36. As shown in FIGS. 2–6 and 10, one of the arms 26 on each antenna half is longer than the other. The length variation tunes the antenna to provide the necessary phase shift for right hand circular polarization (RHCP). The height of the support 14 is made a specific height to provide an optimal gain pattern. Because the antenna is made through printed circuit board (PCB) techniques, the repeatability is high and thus, there is little variation in antenna characteristics.

In an exemplary embodiment, the antenna 10 is designed to received signals between 1525 and 1580 MHZ. This covers the global positioning system (GPS) and the differential global positioning system (DGPS) bands. The gain pattern is optimized to enhance the reception of signals from 30 to 60 degrees above the horizon as these are the angles that the geo-stationary satellite will appear over most of North America.

The above-described method of manufacturing provides both the benefits of printed circuit board (PCB) manufacturing, i.e. low cost and repeatability, with the benefits of a solid metal antenna element, i.e. structural integrity. The antenna provides a wider bandwidth and better gain performance as it is not constrained to a flat surface but due to the semi-rigid PCB technology (flexible PCB with rigid sections laminated thereon) can be made to stand upright unsupported, and once foamed is extremely robust and comparable to conventional solid metal antennas. This has significant cost saving as well as makes the antenna very repeatable as far as consistent element lengths for proper operation.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An antenna comprising:

an antenna element made from a flexible circuit material; and a support, integral with said antenna element, made from the flexible circuit material, said support and said antenna element being formed from a unitary piece of flexible circuit material;

a ground plane, integral with said support, made from a flexible circuit material, said support and said ground plane being formed from a unitary piece of flexible circuit material.

2. The antenna of claim 1 wherein said ground plane includes an adhesive.

3. The antenna of claim 1 wherein said ground plane includes:

a first ground plane portion having a first exposed conductive surface and a first tab extending from said first ground plane portion, said first tab having an exposed conductive surface; and a second ground plane portion having a second exposed conductive surface and a second tab extending from said second ground plane portion, said second tab having an exposed conductive surface;

wherein said first tab makes electrical contact with said second exposed conductive surface and said second tab makes electrical contact with said first exposed conductive surface.

4. The antenna of claim 1 wherein said antenna element includes at least one arm.

5. The antenna of claim 4 wherein said arm includes a stiffener.

6. The antenna of claim 4 further comprising at least one arm extension connected to said arm.

7. The antenna of claim 1 wherein said support includes a stiffener.

8. The antenna of claim 1 wherein said support includes a tapered, strip of conductive material positioned along a portion of a length of said support.

9. The antenna of claim 1 further comprising:

foam encasing said antenna element and said support.

10. An antenna comprising:

an antenna element made from a flexible circuit material, said antenna element includes at least one arm;

a support, integral with said antenna element, made from a flexible circuit material; and at least one arm extension connected to said arm;

wherein said arm extension includes an adhesive.

11. An antenna comprising:

an antenna element made from a flexible circuit material, said antenna element includes at least one arm;

a support, integral with said antenna element, made from a flexible circuit material;

at least one arm extension connected to said arm; and an arm support connected to said arm extension.

12. The antenna of claim 11 wherein said arm support includes an adhesive.

13. An antenna comprising:

an antenna element made from a flexible circuit material;

a support, integral with said antenna element, made from a flexible circuit material;

a ground plane, integral with said support, made from a flexible circuit material, wherein said ground plane includes an adhesive; and a release sheet in contact with said adhesive on said ground plane.

* * * * *